US006538041B1

(12) United States Patent
Marelli

(10) Patent No.: US 6,538,041 B1
(45) Date of Patent: Mar. 25, 2003

(54) APPARATUS AND METHOD FOR FORMING STABILIZED ATOMIZED MICROEMULSIONS

(76) Inventor: Ernesto Marelli, Via Buttero, 20, 23857 Olgiate Molgora (IT)

( * ) Notice: Subject to any disclaimer, the term of this patent is extended or adjusted under 35 U.S.C. 154(b) by 0 days.

(21) Appl. No.: 09/684,649

(22) Filed: Oct. 10, 2000

(30) Foreign Application Priority Data

Oct. 25, 1999 (IT) ..... MI99A2228

(51) Int. Cl.[7] ..... B01F 3/08; B01F 5/06; B01F 17/00

(52) U.S. Cl. ..... 516/21; 366/165.4; 366/167.1; 366/176.1; 366/336; 366/337; 516/53

(58) Field of Search ..... 516/21, 53; 366/167.1, 366/176.1, 165.4, 336, 337

(56) References Cited

U.S. PATENT DOCUMENTS

| | | | | |
|---|---|---|---|---|
| 3,937,445 A | | 2/1976 | Agosta | |
| 4,127,332 A | * | 11/1978 | Thiruvengadam et al. | 366/176.1 X |
| 4,441,823 A | * | 4/1984 | Power | 366/167.1 |
| 4,480,925 A | * | 11/1984 | Dietrich | 366/165.4 X |
| 4,585,357 A | * | 4/1986 | Ogata | 366/337 X |
| 4,597,671 A | * | 7/1986 | Marelli | 366/336 X |
| 4,755,325 A | * | 7/1988 | Osgerby | 516/21 |
| 4,908,154 A | * | 3/1990 | Cook et al. | 516/21 |
| 5,492,654 A | | 2/1996 | Kozjuk et al. | 261/76 |
| 5,793,831 A | * | 8/1998 | Tsiklavri et al. | 366/167.1 X |
| 5,931,771 A | * | 8/1999 | Kozyuk | 516/53 |
| 5,937,906 A | | 8/1999 | Kozyuk | 366/336 X |
| 5,958,495 A | | 9/1999 | Klinksiek | 426/519 |
| 6,211,253 B1 | * | 4/2001 | Marelli | 516/53 |

FOREIGN PATENT DOCUMENTS

| | | |
|---|---|---|
| GB | 2 096 911 | 10/1982 |
| WO | 99 39813 | 9/1999 |

* cited by examiner

*Primary Examiner*—Richard D. Lovering
(74) *Attorney, Agent, or Firm*—Guido Modiano; Albert Josif; Daniel O'Byrne

(57) ABSTRACT

An apparatus and a method for forming stabilized atomized microemulsions from different liquids which are normally immiscible; the apparatus according to the invention comprises a primary chamber and a sequence of at least two cavitation chambers arranged in succession, means for feeding primary and secondary fluids into the primary chamber, and means for the exit of the formed microemulsion from the last cavitation chamber, the primary chamber and the cavitation chambers being fluid-connected to each other by way of fluid passage means which are adapted to produce a velocity of the fluids, during passage through the passage means, which gradually increases from the primary chamber toward the last cavitation chamber. The method according to the invention comprises the stage of premixing the primary fluid with the secondary fluid, followed by the passage of the premix of fluids through a succession of steps of flow at a higher velocity alternated with steps of flow at a lower velocity, the higher flow velocities gradually increasing from the first higher-velocity step to the last higher-velocity step.

20 Claims, 1 Drawing Sheet

APPARATUS AND METHOD FOR FORMING STABILIZED ATOMIZED MICROEMULSIONS

FIELD OF THE INVENTION

The present invention relates to an apparatus and a method for forming stabilized atomized microemulsions from different liquids which are normally mutually immiscible, for the most disparate applications in the chemical-pharmaceutical, food, cosmetic sectors et cetera. In particular, the apparatus and the method according to the present invention allow to form microemulsions with untreated and/or basified water of liquid hydrocarbons, with the most disparate densities and viscosities, for use as fuels for civil and industrial heating systems and also for large engines and/or as fuels for Diesel engines.

BACKGROUND ART

Apparatuses and methods for forming microemulsions are known in the art.

For example, EP-630,398 discloses the formation of emulsions by mixing components in a static mixer in particular pressure and temperature conditions in the presence of a mixture of surfactants.

EP-124,061 in the name of this same Applicant discloses an apparatus and a method for forming emulsions of fluid fuels with other immiscible fluids, particularly water. The described apparatus is constituted by a turbotransducer which comprises an emulsification chamber in which the fluid fuel and the water are subjected to a combined mechanical and electromagnetic action which generates, inside said chamber, a centered corridor through which the mixed fuel and water flow.

EP-373,353, in the name of this same Applicant, discloses a process for producing stabilized emulsions of a fuel, particularly a fuel for Diesel engines, and water, with the addition of a product which acts as a lubricant and antifreeze, which comprises the premixing of fuel, water and additive and the subsequent passage of the resulting mix through a turbotransducer similar to the one of the above-cited EP-124,061.

The Applicant has found that these methods entail a relatively high energy expenditure with respect to the productivity of the system and have a low need for conversion of the energy associated with the passage through the emulsifying apparatus into surface energy of the particles of the disperse phase.

BRIEF DESCRIPTION OF THE INVENTION

The aim of the present invention is to provide a system for obtaining stabilized atomized microemulsions which is even more advanced and most of all less expensive, for the purpose of industrialization with a considerable saving in terms of times and costs for production, maintenance, siting and electric power.

Another object of the present invention is to provide an apparatus which can assume any size and therefore can be inserted directly in production line of any required productivity, even if it is a few liters per hour, and for use in the pharmaceutical and/or cosmetic industry.

Another object of the present invention is to provide an apparatus which can work without very expensive and unreliable ultrasound systems or other devices.

This aim, these objects and others which will become better apparent from the following description are achieved by an emulsifying apparatus according to the invention for forming stabilized atomized microemulsions, which comprises a primary chamber and a sequence of at least two cavitation chambers arranged in succession, means for feeding fluids into said primary chamber, and means for the exit toward the outside of said apparatus of the microemulsion from the last cavitation chamber of the sequence of cavitation chambers, said primary chamber and said at least two cavitation chambers being fluid-connected to each other by way of fluid passage means, said passage means being adapted to produce a velocity of the fluids, during passage, which gradually increases from the primary chamber to the last cavitation chamber of the sequence of cavitation chambers.

DETAILED DESCRIPTION OF THE INVENTION

The apparatus according to the invention includes a reverse-flow diffuser with multiple cavitation chambers, capable of imparting a turbine effect to the fluids. The cavitation chambers can be theoretically unlimited in number and can have the most specific dimensions. In said chambers, the microemulsion takes form from the peripheral region and is perfected in the last cavitation chamber.

The primary chamber can be cylindrical or can also have an oval, square or rectangular cross-section. A polyhedral or triangular cross-section is also possible.

Conveniently, the first cavitation chamber of the sequence of cavitation chambers is at least partially arranged inside the primary chamber and the other cavitation chambers of the sequence of cavitation chambers are is arranged so that each one is at least partially inside the preceding one in the sequence of cavitation chambers.

Advantageously, the cavitation chambers of the sequence of cavitation chambers are each arranged inside the preceding cavitation chambers in the sequence of cavitation chambers, the sequence of cavitation chambers being arranged inside the primary chamber.

In a preferred embodiment, the primary chamber is the container of all the other cavitation chambers installed inside it.

Advantageously, the primary chamber and the cavitation chambers of the sequence of cavitation chambers have substantially parallel axes and are even more advantageously coaxial.

A larger number of cavitation chambers with turbine effect is convenient in the presence of a plurality of secondary fluids with highly contrasting physical and chemical characteristics.

The cavitation chambers of the sequence of cavitation chambers preferably each have a blind wall which is arranged substantially at right angles to the axes of the cavitation chambers and is directed toward the preceding cavitation chamber in the sequence of cavitation chambers.

Preferably, the cavitation chambers of the sequence of cavitation chambers are mutually rigidly coupled and are rigidly coupled to the primary chamber.

The outside of the apparatus, or the surface of the primary chamber, can if necessary be heated for example by means of a self-compensating self-adjusting heating cable and insulated.

The primary cavitation chamber can be made of non-magnetic or scarcely magnetizable steels (AISI 304L, AESI 316L, ASTELLOY C), since if appropriate the system can be activated with magnetic assemblies of lanthanum and/or samarium or cobalt with a high energy yield.

The dimensions of the chamber and the thickness of the walls are chosen according to the productivity required by the user and/or by the process.

Conveniently, the fluid passage means are adapted to impart to the fluids a turbine effect motion.

Preferably, the fluid passage means comprise holes in the walls of the cavitation chambers of the sequence of cavitation chambers.

Advantageously, the holes have longitudinal axes which are inclined with respect to the axis of the corresponding cavitation chamber, the inclination of the axes in the holes of each cavitation chamber of the sequence of cavitation chambers being opposite to the inclination of the axes of the holes of the preceding and subsequent cavitation chambers of the sequence of cavitation chambers.

The number of holes, their cross-section, the inclination of the holes with respect to the horizontal axis, the distance between the surfaces of each chamber, the working volume of each chamber and the total volume of the primary chamber are the basis for the calculations related to the mechanics of obtaining instant stable microemulsions or microcells with assurance of the degree of dispersion of the secondary fluid. In the calculation (volume of chambers, number of holes, cross-section of holes, inclination of holes, distance between the walls of the chambers) it is also necessary to take into high account the chemical-physical parameters of the involved fluids.

For example, the sum of the cross-sections of all the holes of each cavitation chamber should be lower than for the preceding cavitation chamber in the sequence to ensure an increase of the fluid velocity in the holes from the first to the last cavitation chamber in the sequence.

The velocity of the fluids in the holes of the walls of the cavitation chambers gradually increases from the first to the last chamber along the path of the fluid. The velocity in the holes is lower in the holes of the first chamber and can reach even tens or hundreds of meters per second in the holes of the last chamber of the sequence of cavitation chambers.

Preferably, the velocity increase in the holes of the last cavitation chamber with respect to the velocity in the holes of the first cavitation chamber of the sequence of cavitation chambers should not be less than fourfold. Optimally, said increase is greater than eightfold for any characteristic of the fluids.

The means for feeding the fluids into the primary chamber can comprise means for feeding the primary fluid and means for feeding the secondary fluid.

The means for feeding the primary fluid(s) can be preferably constituted, for example, by screw-type electric pumps.

Advantageously, the means for feeding the secondary fluid comprise an injector system equipped with a diffuser shaft provided with holes which are inclined with respect to the longitudinal axis of said stem, the inclination of said holes being such as to allow to propel the secondary fluid into the first cavitation chamber in the opposite direction with respect to the direction in which it enters the shaft.

The holes can have a preferred diameter between 1 and 15 mm, depending on the characteristics of the secondary fluid and on the flow-rate, pressure, viscosity and temperature of the primary fluid.

The outside diameter of the diffuser shaft can vary from 8 to 10 mm up to a reasonable maximum of 150 mm, larger dimensions being possible but seldom feasible or advisable. The total number of holes can vary from a minimum of 24 to a reasonable maximum of 350. The diameter of each hole can vary from a minimum of 1 mm to a technological maximum of 15 mm. The spacing between the axes of each hole can range from a minimum of 5 mm to a maximum of 30 mm.

The holes along the diffuser shaft must be arranged at least on four rows (axially offset by 90° with respect to the cross-section of the diffuser shaft) and preferably on six and/or eight rows which are proportionally axially offset.

In order to avoid any reverse flow of primary fluid toward the source of the secondary fluid, it is possible to interpose between the diffuser shaft and the dosage pump fluid outlet a check valve, for example provided with a ball and spring and set from a minimum of 5 kg to a maximum of 25 kg.

In this case, a preliminary operation to be performed is the filling of the body of the check valve with the secondary fluid before starting the pump that conveys the primary fluid.

The secondary fluid is conveyed normally through electric metering pumps of the plunger type with adjustment of the flow-rate by means of a vernier scale which acts on the stroke of the plunger.

The flow-rate of this electric pump or of the electric pumps is calculated in relation to the maximum percentage of secondary fluid to be introduced. When this parameter exceeds 2000–2500 liters per hour, however, it is convenient to split the flow-rate over a plurality of electric pumps, especially in order to handle motors with limited specific power levels and dimensions (no more than 7–8 kilowatts).

Advantageously, the means for feeding the secondary fluid further comprise a metering valve which is arranged between said diffuser shaft and a metering pump for feeding the secondary fluid.

The primary fluid can be fed through an electric pump of the screw and/or gear and/or plunger and/or hollow-disk and/or multiple-disk type. A screw-type electric pump with adjustment of flow-rate and pressure by means of an adjustable bypass is advisable. Centrifugal pumps are not advisable.

The pressure applied to the primary fluid can be, for example, 0.5 to 1 bar and up to 400 bar or more, according to the chemical-physical characteristics of the secondary fluid and according to the characteristics of the electric pumps that convey the secondary fluid, since said pumps must automatically apply a pressure drop delta-p ($\Delta p$) to the secondary fluid so that it can be introduced in the first primary chamber.

For the sake of convenience, the pressure imparted is the one best allowed by the type of electric pump in relation to its reliability, but also in relation to the physical-chemical characteristics of the working fluids and in relation to the characteristic of the electric pump that conveys the secondary fluid, which has to apply to the secondary fluid a pressure increase of at least 1 and/or 2 bars with respect to the primary pressure in an automatic manner. For this purpose, the secondary pressure feeding assembly that is provided is an electric pump of the pulsating plunger type.

The temperature of the fluids must be the most appropriate in relation to the most appropriate working viscosity of the process fluid and to its chemical-physical content.

As an alternative, the means for feeding the fluids in the first feeding chamber comprise means for feeding the primary fluid and the secondary fluid, possibly pre-mixed but dosed with respect to each other in the most appropriate ratios.

The means for the discharge of the microemulsion from the apparatus conveniently comprise a duct provided with a control valve.

Advantageously, a pressure adjustment device is arranged on the duct in a position which lies upstream of the control valve.

The apparatus according to the invention can be constituted by a particular mechanical assembly with multiple cavitation chambers which are preferably coaxial and are affected by fluids on their outer surface and, through holes formed in the outer surface in appropriate sizes and with angles (with respect to the horizontal axis) evaluated in relation to the characteristics of most of the intended fluids and to the dimensions of the various successive cavitation chambers (optionally arranged one inside the other), propels the fluids that flow through it from the outside inward, diffusing them into all of the occupied volume owing to the very high turbulence.

The process is repeated every time the fluids flow from the primary chamber toward the last cavitation chamber, i.e., in the embodiment with coaxial chambers arranged inside each other, from the outer chamber to the inner chamber. The flow of the mass of fluid, and therefore the process, occur with a path from the outside inward and not vice versa as in the presence of a diffuser which receives the fluid internally and propels it into an external volume, known as direct-flow diffuser. Accordingly, the apparatus according to the invention can be termed reverse-flow diffuser.

The apparatus according to the present invention is adapted for providing a turbine effect in the fluids that flow through it; this expression is used since the fluids provided with energy are propelled against the outer surface of each chamber (as occurs in typical turbines with respect to the vanes).

The energy of the fluids, however, is not transferred to provide motion, as in the case of the fluid of a turbine on the vanes of the wheel, but is retained until exit from the last cavitation chamber, i.e., the innermost one, occurs, where through the gauged and angled holes the velocity acquired by the fluid is n times higher than the velocity of entry into the first cavitation chamber and the applied energy has been used to form microcells constituted by the fluids involved in the process.

The particular geometry and dimensions of each cavitation chamber, the number of holes of each chamber, the diameter and angle of the holes and therefore the energy imparted to the fluids produce intense turbulence, as desired by the assumptions on which the invention is based.

By definition, the characteristics of a turbulent motion are irregularity of the velocity of each particle that constitutes the fluid (and/or the fluids) both when they make contact with fluid streams having different velocities and when the fluids flow in contact with solid walls.

The characteristics of turbulence are, therefore, the irregularity of the velocity of each particle of fluid and the chaotic behavior of said particle with respect to the continuity and constancy of its trajectory.

Since it is impossible to determine the instantaneous values of each factor involved in the process related to the fluid particles, the system according to the invention hypothesizes a "mixing path" of each particle of secondary fluid (in relation to the turbine effect, i.e., to the turbulent motion) such that the particle reaches a state in which it loses its individuality and dissolves into the whole.

The hypothesized turbine effect, which is plausible in this situation, cannot be the isotropic one, since an agitation motion which is identical in every point of the process volume is not conceivable, and also cannot be the "free" one, due to the presence of walls and in any case to the vicinity of said walls both to the fluid and to each other.

However, one can hypothesize situations of "constrained turbulence", since the fluid currents are in contact with the solid walls, and of "anisotropic turbulence", since turbulence in the vicinity of the solid walls is certainly conceivable.

The process involves increases in the friction coefficient and in the coefficient of heat transmission between the fluid current and the solid wall.

The turbine effect and therefore the high turbulence are also helped by the mutually axially offset position of the holes of each chamber with respect to the successive one, particularly of each outer chamber with respect to the successive inner one.

The application of high-energy permanent magnets (arranged outside the primary chamber made of non-magnetic material which contains the successive chambers made of magnetizable material), although possible, has no influence, since the magnetic field would close only through the first cavitation chamber, where additionally the state of turbulence is not at its maximum level and neither is the velocity of the fluid in the hole. Even by applying ultrasonic systems with transducers of the piezoelectric or magnetostrictive type to the surface of the first chamber, the mechanical action or cavitation action on the affected fluid would not be improved when the cavitation chambers are concentric and coaxial.

Another aspect of the present invention relates to a method for producing a stabilized atomized microemulsion comprising the stages of:

a. premixing a secondary fluid with a primary fluid in order to provide a premix, for example a macrocell emulsion;

b. subjecting said premix to a succession of steps of flow at a higher average velocity, alternated with steps of flow at a lower average velocity, the high-velocity flow steps being provided at velocity values which gradually increase.

Preferably, the increase in velocity in the steps of high-velocity flow is at least fourfold, more preferably eightfold, from a first step of high-velocity flow to a last step of high-velocity flow.

The alternation of steps of flow at higher average flow velocities and of steps of flow at lower average velocities of the method according to the invention can be provided by passing a given flow-rate of premixed fluids alternately through narrower and wider flow sections.

In this case, both the narrower flow sections and the wider flow sections are gradually reduced along the path of the fluids.

An embodiment of the apparatus according to the present invention and its operation are now described in detail with reference to FIG. 1. The invention must be considered as being limited to this embodiment, which is presented merely by way of non-limitative example.

BRIEF DESCRIPTION OF DRAWING

The apparatus comprises an outer primary chamber C1 and a sequence of cavitation chambers C1–C5. The primary chamber C1 is the container for all the other cavitation chambers C2–C5, which are installed inside it.

The secondary fluid enters the primary chamber by means of a direct diffuser element A1 which comprises a perforated diffuser shaft. The axis of the holes with respect to the longitudinal axis of the diffuser shaft is inclined by 25°. The inclination is such as to direct the secondary fluid in the opposite direction with respect to the entry direction.

Figure 1:
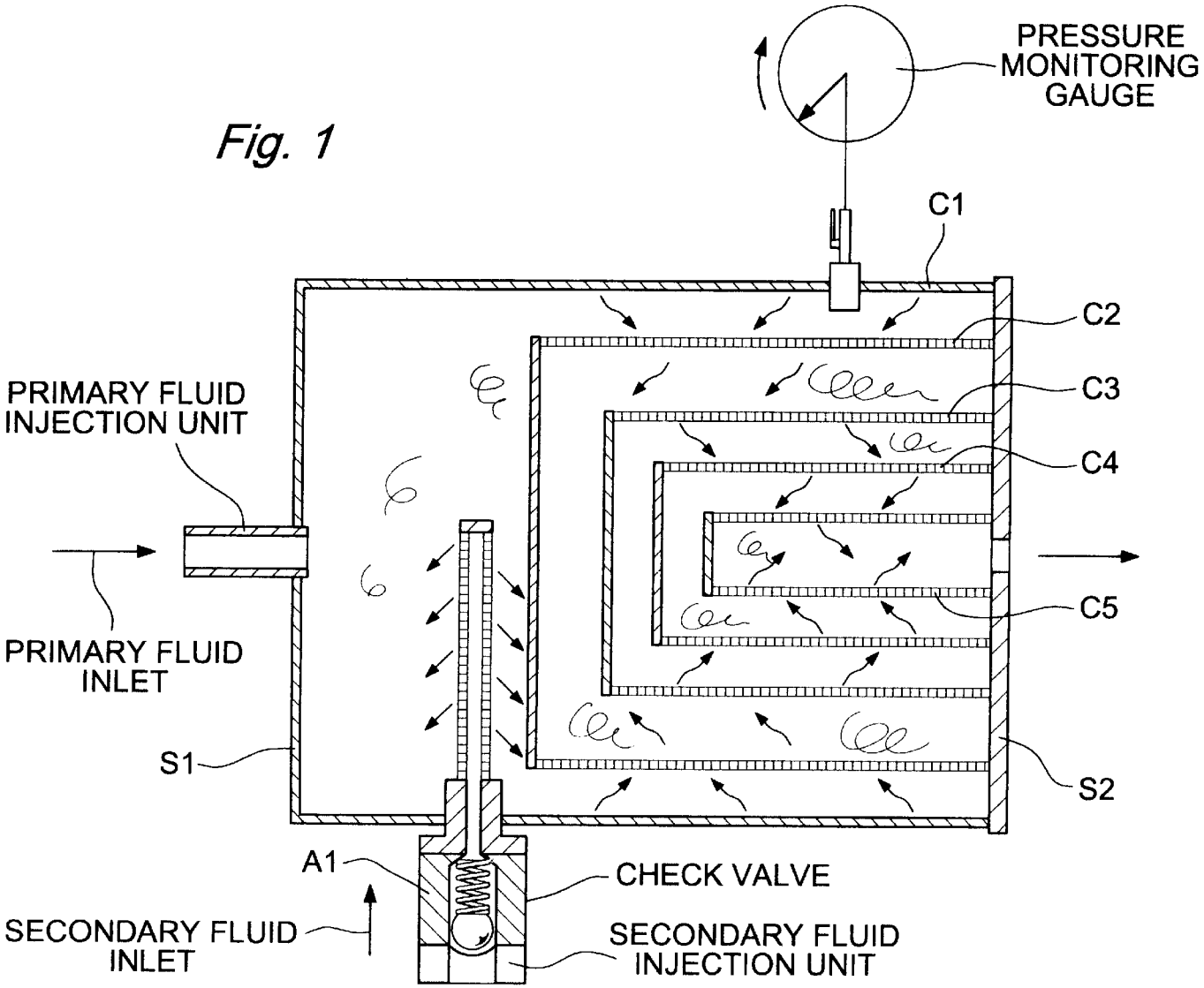

The chamber C1 receives at one end the primary fluid and, for the sake of convenience in operation, the inlet(s) of the secondary fluid(s) is (are) arranged at right angles.

Premixing with formation of chaotic and heterogeneous macrocells occurs in the chamber C1.

The cavitation chambers C2, C3, C4, C5, which produce the turbine effect with reverse diffusion, convey the perfected fluid (microemulsion) toward the outlet of the system according to the "reverse-flow diffuser" concept.

In a preferred embodiment of the apparatus according to the present invention:

- the chamber C2 has twice as many holes as the chamber C3;
- the diameter of the holes of C2 is twice the diameter of the holes of C3;
- the inclination of the holes of C2 with respect to the longitudinal axis of the system is 25° and the fluid enters from right to left;
- the chamber C3 has three times as many holes as the chamber C4;
- the diameter of the holes of C3 is twice that of the holes of C4;
- the inclination of the holes of C3 with respect to the longitudinal axis of the system is 25° and the fluid enters from the left and exits to the right (the opposite of what occurs in the chamber C2);
- the chamber C4 has four times as many holes as the chamber C5;
- the diameter of the holes of C4 is twice the diameter of the holes of C5;
- the inclination of the holes of C4 with respect to the longitudinal axis of the system is 15° and the fluid enters from the right and exits to the left (the opposite of what occurs in the chamber C3);
- the chamber C5 has one quarter of the holes of the chamber C4;
- the diameter of the holes of C5 is half the diameter of the holes of C4;
- the inclination of the holes of C5 with respect to the longitudinal axis of the system is 15° and the fluid enters from the left and exits to the right (the opposite with respect to what occurs in the chamber C4);
- the fluid exits from the chamber C5, and therefore from the system, and the formed microemulsion is perfected, milky and such as to allow no separation of the secondary fluid (for example water) even if it is subjected to thermal variations and/or centrifugation up to values of over 30,000 m/s$^2$ for over 60 minutes, after heating at 50° C.;
- the chambers C2, C3, C4, C5 as indicated in FIG. 1 have a blind surface S1, while each surface S2 is rigidly coupled to the set of chambers; said chambers are rigidly coupled to C1 by welding and/or threading and/or flanging, for example;
- the sets C2, C3, C4, C5 can therefore be applied to C1 even merely by threaded or flanged fitting for maintenance purposes, as shown in the drawing;
- the duct that conveys the discharge of the emulsion is provided with a control valve (for example of the needle type with calibration) in order to be able to adjust the operating pressure of the fluids according to requirements;
- between said valve and the system shown in FIG. 1 there is an interposed pressure control of the electronic type (remote pressure-controlled switch) and there are two exclusively settable (min-max) pressure controls; an electronic pressure gauge should conveniently be applied also to the inlet of the system. The two instruments allow to evaluate the pressure loss of the fluids between the inlet and the outlet of the system.

The characteristics of a preferred embodiment of the apparatus according to the present invention are given in Table 1.

The data relate to a system of the type provided for a productivity of 20,000 kg/hour of water-fuel oil microemulsion for feeding the heating units of an industrial powerstation. The viscosity of the fuel oil is 50°E at 50° C. (approximately 380 cSt). The operating temperature is 85° C. and the operating viscosity is approximately 6°E (approximately 45.5 cSt). The operating pressure is 20 bars. The water is untreated water from the mains and the operating pressure is 22 bar.

TABLE 1

| Cavitation chamber | No. of holes | Diameter of holes (mm) | Angle of holes (deg) | Fluid inlet | Fluid outlet | Velocity of motion in holes (m/s) | Hole cross-section (mm$^2$) | Hole flow-rate (liters/hour) | Hole flow-rate (liters/min) | Total cross-section of holes (mm$^2$) | Velocity increases in hole between chambers |
|---|---|---|---|---|---|---|---|---|---|---|---|
| C2 | 2400 | 24 | 25 | Right | Left | 0.005 | 452.16 | 8.3 | 0.138 | 1086000 | C2 < 8 times C3 |
| C3 | 1200 | 12 | 25 | Left | Right | 0.041 | 113.04 | 16.7 | 0.28 | 136.000 | C3 < 12 times C4 |
| C4 | 400 | 6 | 15 | Right | Left | 0.49 | 28.26 | 50 | 0.83 | 11.304 | C4 < 16 times C5 |
| C5 | 100 | 3 | 15 | Left | Right | 7.87 | 7.065 | 200 | 3.33 | 706.5 | C5 > 1574 times C2 |
| | | | | | | | | | | | C5 > 192 times C3 |
| | | | | | | | | | | | C5 > 16 times C4 |

Note:
Velocity of motion W in meters per second = flow-rate in hole in liters/hour (q)/cross-section of the hole in mm$^2$ (S)
From the size ratio W = 0.278 · q/S, in meters/second Data related to another preferred embodiment of the present invention are given in Table 2.

The example relates to an apparatus of the type with three internal chambers for a theoretical total flow-rate of 150 to 17,000 kg/hour (liters/hour). The average operating pressure is 25 bar, the viscosity of the primary fluid is 50°E and 50° C., the primary fluid density is 0.98 kg/dm$^3$, and the operating temperature is 80° C.

TABLE 2

Total flow-rate of 150 l/h system

| Cavitation chamber | No. of holes | Diameter of holes (mm) | Cross-section of each hole ($mm^2$) | Total flow-rate (l/h) | Total flow-rate of each hole (approx l/h) | Velocity in hole (approx m/s) | Useful volume of each chamber ($mm^3$) | Velocity ratio |
|---|---|---|---|---|---|---|---|---|
| C1 | 88 | 4 | 12.56 | 150 | 1.7 | 0.04 | 1,361,190 | C1 < 4.5 C3 |
| C2 | 60 | 3 | 7.065 | 150 | 2.5 | 2.5 | 270,236 | C2 > 2.5 C1 |
| C3 | 32 | 3 | 7.065 | 150 | 4.7 | 0.18 | 22,687 | C3 > 1.8 C2 |

Total of passages in holes: 188

Ratio of volumes to no. of times:

$V_1>V_2=5$ $V_2<V_3=12$ $V_1>V_3=60$

The system described in Table 2 and the indicated dimensions allow application up to a flow-rate of 17,000 kg/h (17,000 l/h) in the presence of fluids with densities up to 1.5 $kg/dm^3$ and viscosities up to 6°E (approximately 45.5 cSt) at the temperature of 80–85° C.

As specified above, the dimensions, the geometry, the number of holes and their cross-section are in fact possible even with fluid conveyance pressures up to 35–40 bar.

The maximum flow-rate in the hole of the innermost and more limitative chamber C3 is approximately 531 l/h, i.e., approximately 8.9 l/min, and the velocity in the hole of C3 would be equal to 21 m/s, i.e., approximately 5 times higher than the velocity in the hole of C1, which would be only 4.3 m/s. This ratio, which is always higher than at least 4 times between the innermost chamber and the outermost chamber, is essential in order to obtain the microemulsion within the spaces and microtimes allowed by the dimensions of the EMDT5 system.

The indicated system, capable of a minimum productivity of 150 kg/h and up to a maximum of 17,000 kg/h (and/or liters/hour) assumes an indicative dimension with a minimum diameter of 290 mm and a minimum length of 320 mm, up to a maximum diameter of 600 mm and a length of 800 mm.

Using other previous technologies, the system would not be composed of a single unit but of at least four units with overall dimensions of 3000 mm×1400×1700 h and with a total reserved power of 27 kilowatts with respect to 6 kilowatts of the exemplified system.

The increase in the velocity of motion in the holes according to the indicated parameters, expressed in the examples referred to Tables 1 and 2, is fundamental. The indicated velocities would not be possible with systems having a single cavitation chamber which, although having inlet/outlet diffusers with different calibrations but arranged in a line, would not allow uniformity of flow in the presence of such different parameters as, for example, the fundamental one indicated between the chamber C2 and C5, since the pressure of the fluid in input would rise to such high values as to produce process heterogeneity due to cavitation of the electric pump and also due to the continuous intervention of the thermal contact for protecting the remote switch that drives the pump motor, in view of the high current peaks to which the motor would be subjected.

The apparatus according to the invention provides a microemulsion whose cell dimensions do not exceed 0.2–0.15 microns and the secondary fluid, on the total microemulsion, can be even 70% in the case of, for example, water and liquid hydrocarbons used as a heating or propulsion fuel.

Other examples of primary and secondary fluids for preparing microemulsions according to the invention can be distilled water and active principles obtained from herbs, optionally with surfactants in order to form medicines, creams, toothpastes, food flavorings.

The industrialization and application of the apparatus according to the invention entails extremely low costs which are greatly different from the costs entailed by any other known technology.

The process that occurs in the apparatus according to the invention relates to fluid-dynamics aspects in which the fluid mixing process is immediate, in view of the high turbulence caused by the considerable increases in the velocity of the motion in the holes.

The apparatus according to the invention can be constituted by a single module which can assume any dimensions according to the required capacity without therefore necessarily entailing a plurality of modules arranged in series and/or in parallel. This leads to a considerable saving in terms of costs and time for production, maintenance, siting and electric power.

The disclosures in Italian Patent Application No. MI99A002228 from which this application claims priority are incorporated herein by reference.

What is claimed is:

1. An emulsifying apparatus for forming stabilized atomized microemulsions, comprising a primary chamber and a sequence of at least two cavitation chambers arranged in succession, means for feeding primary fluid(s) and secondary fluid(s), either separate or pre-mixed, into the primary chamber, and means for the exit of the microemulsion from the last cavitation chamber of the sequence of cavitation chambers toward the outside of said apparatus, said primary chamber and said at least two cavitation chambers being fluid-connected to each other by way of fluid passage means, said passage means being adapted to produce a velocity of the fluids, during passage through said passage means, which gradually increases from the primary chamber to the last cavitation chamber of the sequence of cavitation chambers.

2. The apparatus according to claim 1, wherein the first cavitation chamber of the sequence of cavitation chambers is at least partially arranged inside the primary chamber and the other cavitation chambers of the sequence of cavitation chambers are each at least partially arranged inside the preceding one in the sequence of cavitation chambers.

3. The apparatus according to claim 1, wherein said primary chamber and said cavitation chambers of the sequence of cavitation chambers have substantially parallel axes or are coaxial.

4. The apparatus according to claim 1, wherein said means for the passage of the fluids comprise holes in the walls of the cavitation chambers of the sequence of cavitation chambers.

5. The apparatus according to claim 4, wherein said holes have longitudinal holes which are inclined with respect to the axis of the corresponding cavitation chamber, the inclination of the axes of the holes of each cavitation chamber of the sequence of cavitation chambers being opposite to the inclination of the axes of the holes of the preceding and subsequent cavitation chambers of the sequence of cavitation chambers.

6. The apparatus according to claim 1, wherein said means for feeding the secondary fluid comprise a diffuser shaft which is provided with holes which are inclined with respect to the longitudinal axis of said stem, the inclination of said holes being such as to allow to propel the secondary fluid inside said primary chamber in the opposite direction with respect to its direction of entry into the shaft.

7. The apparatus according to claim 6, wherein said secondary fluid feeder means further comprise a check and/or one-way valve for the secondary fluid(s) which is arranged between said diffuser shaft and a metering pump for feeding the secondary fluid.

8. The apparatus according to claim 1, wherein said means for the discharge of the microemulsion comprise a duct provided with a control valve.

9. The apparatus according to claim 8, wherein it comprises a device for adjusting the pressure on said duct upstream of said control valve.

10. The apparatus according to claim 1, wherein the increase in the velocity of the fluids during passage through said means for passage from the primary chamber to the last cavitation chamber is at least fourfold.

11. The apparatus according to claim 10, wherein said cavitation chambers of the sequence of cavitation chambers are mutually rigidly coupled and are rigidly coupled to the first cavitation chamber and to the primary chamber.

12. Apparatus according to claim 10 wherein the increase in the velocity of the fluids during passage through said means for passage from the primary chambers to the last cavitation chamber is eightfold.

13. Apparatus according to claim 10 wherein the increase in the velocity of the fluids during passage through said means for passage from the primary chambers to the last cavitation chamber is more than eightfold.

14. The apparatus according to claim 10, wherein said cavitation chambers of the sequence of cavitation chambers are each arranged inside the preceding cavitation chamber in the sequence of cavitation chambers, the sequence of cavitation chambers being arranged inside the primary chamber.

15. The apparatus according to claim 14, wherein said cavitation chambers of the sequence of cavitation chambers each have a blind wall which is arranged substantially at right angles to said axes and is directed toward the preceding cavitation chamber in the sequence of cavitation chambers.

16. A method for producing a stabilized atomized microemulsion, comprising the steps of:

a. premixing a primary fluid with a secondary fluid in order to form a premix; and b. subjecting said premix to a succession of steps of flow at a first velocity alternated with steps of flow at a second velocity, said first velocity being higher than the second velocity, said steps of flow at higher velocity being provided at velocity values which gradually increase from a first step of flow at higher velocity to a last step of flow at higher velocity.

17. The method according to claim 10, wherein in said steps of flow at lower velocity the fluids are imparted a motion having a turbine effect.

18. The method according to claim 16, wherein the velocity increase in the steps of flow at higher velocity is at least fourfold from a first step of flow at higher velocity to a last step of flow at higher velocity of the succession of steps of flow at higher velocity.

19. The method according to claim 18 wherein the velocity increase in the steps of flow at higher velocity is eightfold from a first step of flow at higher velocity to a last step of flow at higher velocity of the succession of steps of flow at higher velocity.

20. The method according to claim 18 wherein the velocity increase in the steps of flow at higher velocity is more than eightfold from a first step of flow at higher velocity to a last step of flow at higher velocity of the succession of steps of flow at higher velocity.

* * * * *